US007814730B2

(12) United States Patent
Grobenstieg et al.

(10) Patent No.: US 7,814,730 B2
(45) Date of Patent: Oct. 19, 2010

(54) PROFILE FOR FITTING A DIGGER WITH A HOE BUCKET OR LOADING SHOVEL AND METHOD FOR PRODUCTION

(75) Inventors: Armin Grobenstieg, Essen (DE); Detlef Beckmann, Lünen (DE)

(73) Assignee: Bucyrus HEX GmbH, Dortmund (DE)

( * ) Notice: Subject to any disclaimer, the term of this patent is extended or adjusted under 35 U.S.C. 154(b) by 1535 days.

(21) Appl. No.: 10/537,772

(22) PCT Filed: Dec. 2, 2003

(86) PCT No.: PCT/EP03/13544

§ 371 (c)(1),
(2), (4) Date: Jun. 6, 2005

(87) PCT Pub. No.: WO2004/053241

PCT Pub. Date: Jun. 24, 2004

(65) Prior Publication Data

US 2006/0021264 A1 Feb. 2, 2006

(30) Foreign Application Priority Data

Dec. 6, 2002 (DE) ..... 102 57 041

(51) Int. Cl.
*E02F 3/38* (2006.01)

(52) U.S. Cl. ..... 52/843; 52/123.1; 52/111; 29/897.2; 29/524; 29/525.14; 228/141.1; 228/155

(58) Field of Classification Search ..... 52/111–121, 52/123.1, 632, 731.2, 731.6, 737.6, 843; 29/897.2, 524, 525.14; 228/141.1, 155–163
See application file for complete search history.

(56) References Cited

U.S. PATENT DOCUMENTS

| | | | | |
|---|---|---|---|---|
| 2,984,373 A | | 5/1961 | Przybylski | |
| 4,016,688 A | * | 4/1977 | Tiffin et al. | 52/118 |
| 4,034,876 A | | 7/1977 | Yancey | |
| 4,193,734 A | * | 3/1980 | Williams | 414/694 |
| 4,216,895 A | | 8/1980 | Holmes | |
| 4,257,201 A | * | 3/1981 | Landolt et al. | 52/118 |
| 4,337,601 A | * | 7/1982 | Vaerk et al. | 52/118 |
| 4,428,173 A | * | 1/1984 | Knell | 52/731.6 |
| 4,989,774 A | * | 2/1991 | Stephen et al. | 228/157 |
| 5,152,659 A | * | 10/1992 | Waka | 52/632 |

FOREIGN PATENT DOCUMENTS

| | | |
|---|---|---|
| DE | 23 17 595 | 10/1974 |
| DE | 19882547 | 11/2007 |
| JP | 11021939 | 1/1999 |
| JP | 2001020311 | 1/2001 |

OTHER PUBLICATIONS

Patent Abstracts of Japan, Sep. 30, 1997, vol. 1997, No. 09.

* cited by examiner

*Primary Examiner*—Richard E Chilcot, Jr.
*Assistant Examiner*—Matthew J Smith
(74) *Attorney, Agent, or Firm*—Venable LLP; Robert Kinberg; Leigh D. Thelen

(57) ABSTRACT

The invention relates to a welded profile for fitting a digger with a hoe bucket or loading shovel, such as a boom or stanchion, comprising upper and lower webs and sidewalls cooperating therewith, whereby the sidewalls are provided with upper and lower profile reinforced end regions which form the corner regions for the upper and lower webs arranged between the end regions.

14 Claims, 8 Drawing Sheets

PROFILE FOR FITTING A DIGGER WITH A HOE BUCKET OR LOADING SHOVEL AND METHOD FOR PRODUCTION

The invention relates to a welded profile for fitting a digger with a backhoe bucket or loading shovel, such as a boom and arms, as defined in the preamble to claim one of the patent claims.

Reference U.S. Pat. No. 4,034,876 discloses a boom design for a hydraulic digger and a method for producing the boom. The boom has a curved outer contour and comprises an upper flange and a lower flange as well as two sidewalls disposed in-between. For this, the upper flange and the lower flange are provided with wall regions having tapered cross-sections, wherein additional reinforcing support elements are arranged on the inside. Separate positioning areas are welded on in the region of the upper flange for the cylinder attachment points. This type of welded connection, however, results in the creating of undesirable stresses in highly stressed local regions.

A similar design is disclosed in reference JP-A 11 021 939, wherein sidewalls having smaller cross-sectional dimensions are disposed between the upper and lower flanges provided with reinforced end regions.

Reference JP-A 200 102 0311 discloses a different cross-sectional profile for a digger boom for which the upper and lower flanges as well as sidewalls are welded in between individual corner regions.

Reference DE-A 198 82 547 relates to the boom of a mechanical shovel, as well as a method for producing same. The boom is shaped in the manner of a boomerang, wherein the supporting end of the boom is mounted on a vehicle superstructure and an arm is provided on the front end of the boom. The body of the boom is hollow and has a triangular cross section.

Reference U.S. Pat. No. 2,984,373 describes digging equipment mounted on a vehicle. The telescoping boom has a square cross section, wherein the upper flange and the lower flange as well as the sidewalls disposed in-between have approximately the same thickness.

Reference U.S. Pat. No. 4,257,201 also discloses a vehicle with a telescoping crane jib mounted on it. The connecting regions of the sidewalls and the upper flange are provided with profiled reinforced areas for accommodating sliding bodies, wherein the upper flange and the sidewalls are attached to these reinforced areas and reinforced connecting elements extend between lower flange and sidewalls.

It is the object of the present invention to modify a welded profile, as described in the preamble to claim one, which is used for attaching a loading shovel and backhoe bucket in such a way that it results in a reduction of stresses in highly stressed local regions. The modified profile design is intended to shift the welding seams to regions with lower stresses, so that the stress concentrations of the welding seams becomes less important which, in the final analysis, leads to an increase in the service life of the components.

This object is solved according to the invention with the characterizing features as disclosed in the first patent claim.

Advantageous modifications of the subject matter of the invention follow from the concrete dependent claims.

With a method for producing a welded profile for attaching a backhoe bucket and loading shovel to a digger, such as a boom and arms, for which lower and upper flanges are welded to the sidewall regions, it is proposed according to the invention that the sidewalls be connected to the upper and lower reinforced profile end regions, in particular by welding, that the lower flange be inserted between the associated end regions and welded thereto, and that the upper flange be inserted between the associated end regions and welded thereto, and that optionally the end regions of the upper and lower flange are provided with contours that are designed to form the integrated regions for the cylinder attachment points.

As a result of the profile design according to the invention, the welding seams are moved to areas of lower stress, so that the stress concentration of the welding seams can be reduced considerably. This measure consequently results in an increase in the component service life of, in particular of the booms and arms of diggers and especially hydraulic diggers. The use of the subject matter of the invention is of particular interest for large hydraulic diggers, such as are used among others for mining operations. Machinery of this type is used in extremely difficult terrain, thus causing material fatigue to become a very costly factor since any damages will render the digger unavailable for a longer period of time.

Differing from the prior art, the upper and lower flanges of the proposed profile are inserted between the sidewalls, in particular between the end regions with reinforced profile connected thereto, and are then welded on.

The respective end regions with reinforced material cross section are designed analog to the sidewalls—corresponding to the respective contour of the boom and arm—and are connected to these by welding.

The proposed profile has the additional advantage that by integrating the locations for attaching the cylinder and hydraulic system into the reinforced profile end regions on the upper flange, all presently existing welding seams in those locations can be omitted.

From a production-technological point of vie, this permits a simplified design of the structural components without requiring assembly devices.

The subject matter of the invention is shown with the aid of an exemplary embodiment in the drawing and is described as follows, wherein.

Figure 1:
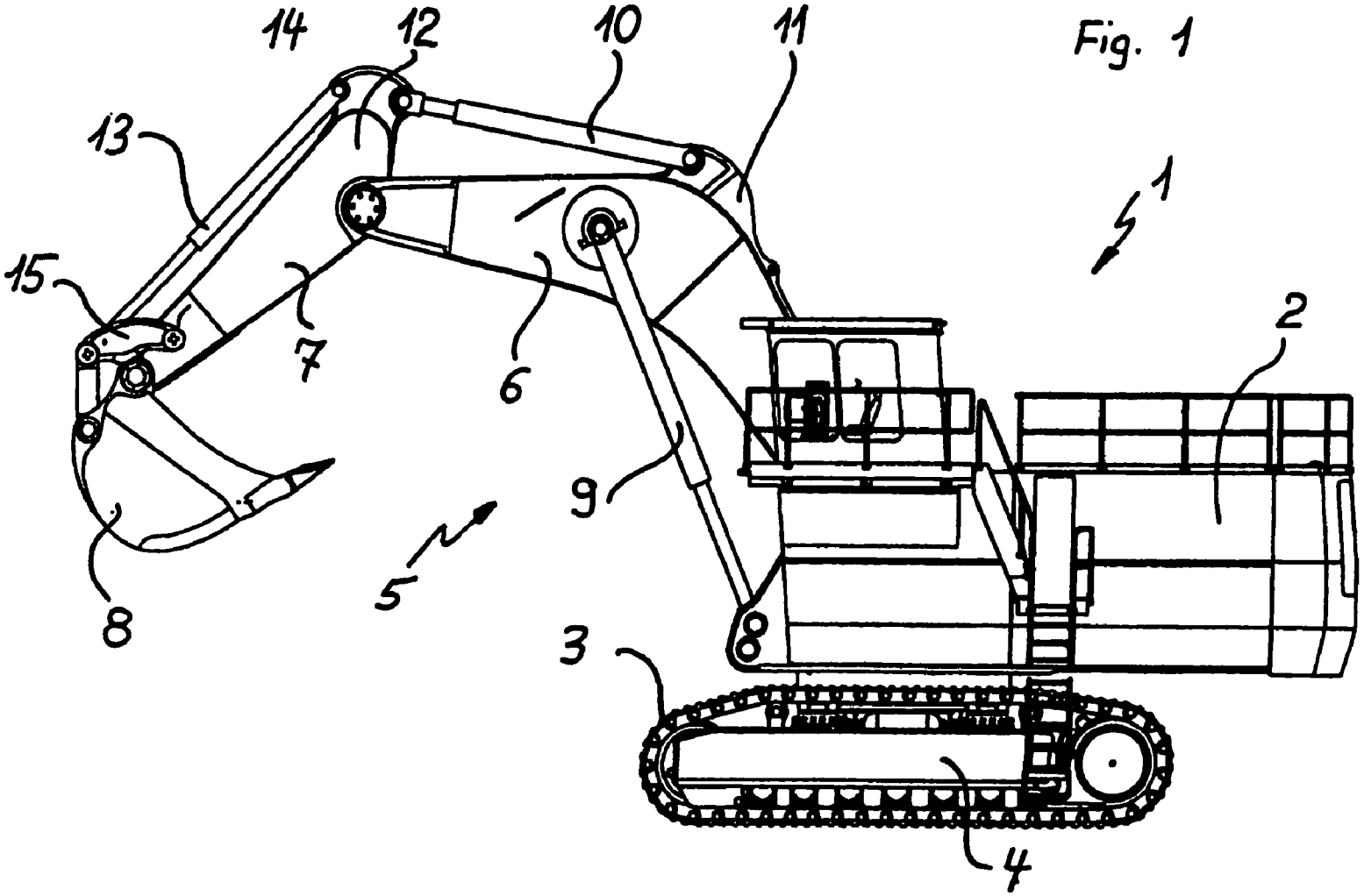
FIG. 1 Shows a schematic diagram of a hydraulic digger provided with a backhoe bucket.

FIG. 1 depicts a hydraulic digger 1, comprising an upper carriage 2 as well as a lower carriage 4 provided with crawler tread belts 3. The hydraulic digger 1 in this example is provided with a backhoe bucket attachment 5, comprising a boom 6, an arm 7, as well as a bucket 8. The boom 6 is positioned in the upper carriage 2 by means of a hydraulic cylinder 9. A different hydraulic cylinder 10 extends between an attachment profile 11 that is welded to the boom 6 and one end 12 of the arm. Another hydraulic cylinder 13 extends between an attachment point 14 on the arm and a positioning location 15 on the shovel which takes the form of a lever arm support.

Figure 2:
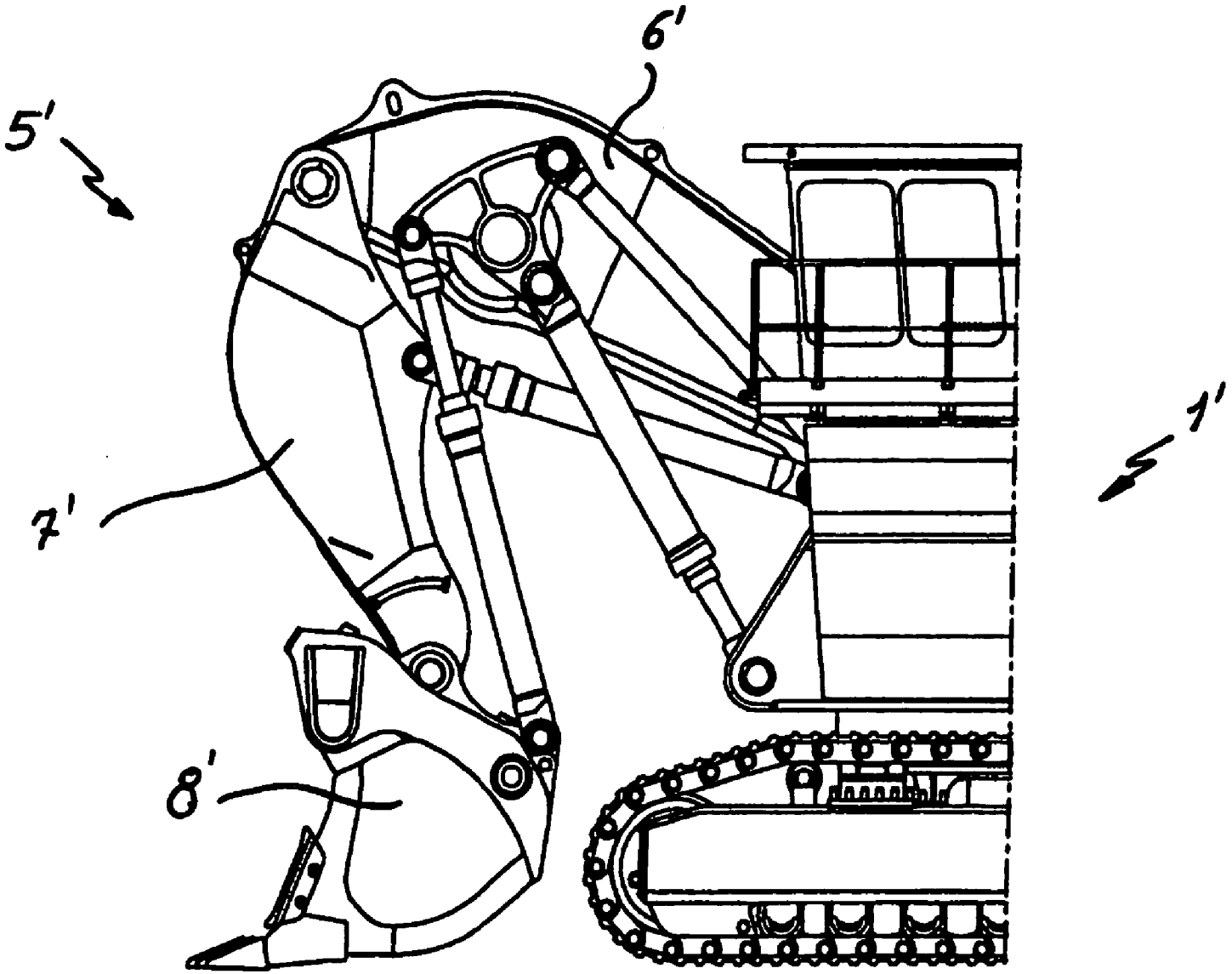
FIG. 2 Shows a schematic diagram of a hydraulic digger provided with a loading shovel.

FIG. 2 shows a schematic diagram of a hydraulic digger 1' equipped with a loading shovel 5'. The main structural components of the loading shovel 5' attachment are the boom 6', the arm 7', as well as the loading shovel 8'.

Figure 3:
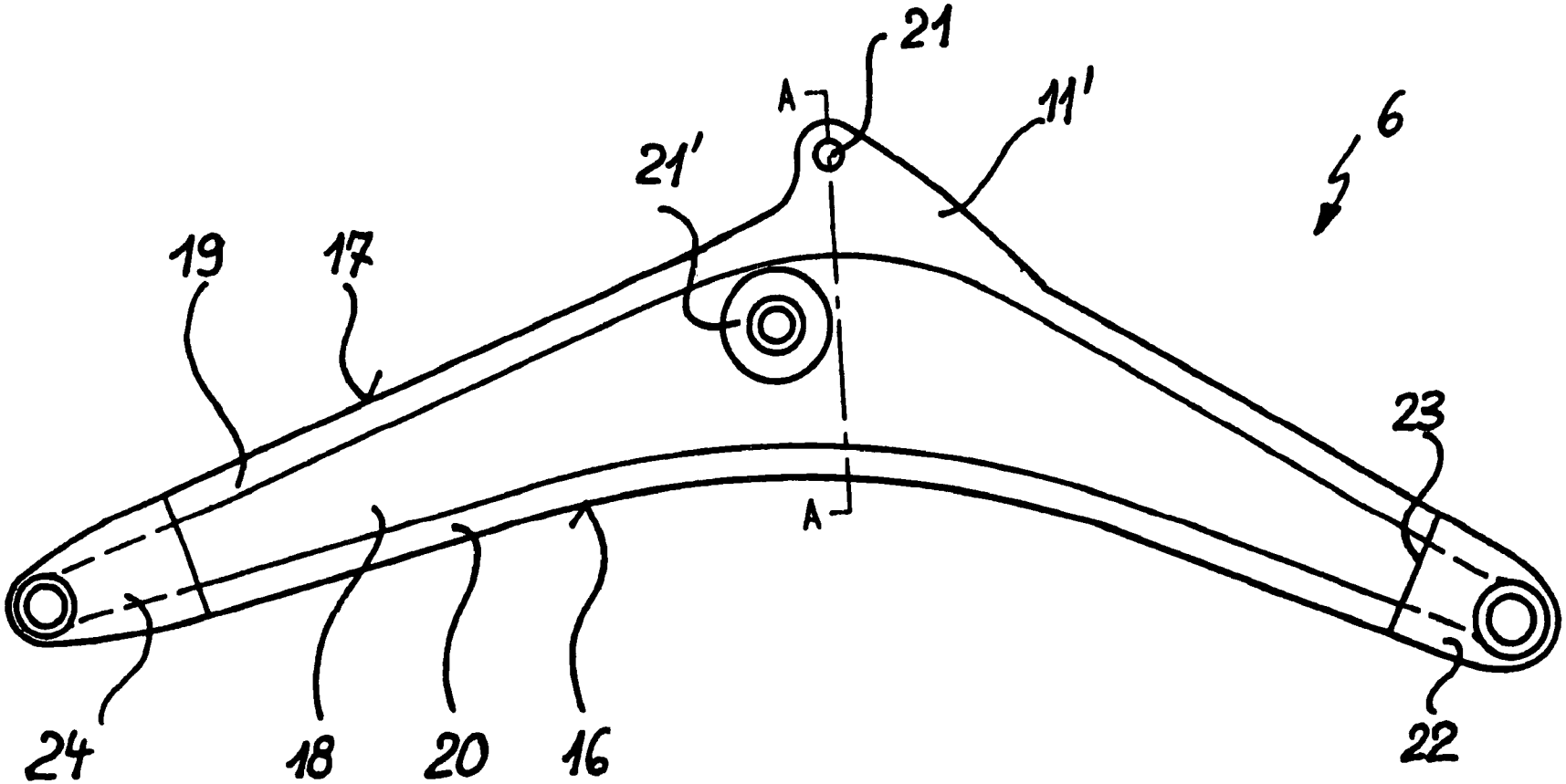
FIG. 3 Shows a sectional view of a boom according to FIG. 1 or 2.

FIG. 3 contains a schematic diagram of the boom 6 shown in FIG. 1, which comprises the features according to the invention. The boom 6 is provided with a lower flange 16, an upper flange 17, sidewalls 18, as well as upper and lower end regions 19, 20 with reinforced profile. The following Figures show in further detail that the parallel-extending sidewalls 18 are connected by welding to upper and lower reinforced profile end regions 19, 20 which form the corner regions for the upper flange 17 and the lower flange 16, arranged between the end regions 19, 20. According to the invention, the contour for the separate profile 11 shown in FIG. 1 matches the contour of the reinforced profile end regions 19 on the upper flange (integrated attachment regions 11'), so that all previously existing welding seams at these locations can be omitted as a result of integrating the attachment points 21 for the cylinders 10 shown in FIG. 1 (but not shown herein). The base bearing point 22 is shaped to match the cross section of the boom 6 and/or 6' in the connecting region 23 and is connected thereto by welding. The same holds true for the fork-shaped attachment region 24 for the arm 7 according to FIG. 1 which is not shown in further detail herein. The positioning region 21' in the sidewalls 18 is used for attaching one end of the hydraulic cylinder 9 which is shown in FIG. 1.

FIGS. 4 to 8 show different cross sections for different booms 6, for example as shown in FIG. 3. The following components are visible: the lower flange 16, the upper flange 17, the sidewalls 18, the lower end region 20 with reinforced profile, as well as the positioning regions 21 which are integrated into the upper reinforced end regions 19. In the region of the connecting locations 25, 26, the sidewalls 18 are welded to the end regions 19, 20 with a wider, reinforced-profile cross section.

Differences between the FIGS. 4 to 8 must be seen in that the end regions with reinforced profile are provided with cross-section reducing areas 27, 28, such that they fit flush on the inside or outside or such that they are centered. On the one hand this results in a profile with smooth inside contour 29 (FIG. 5) and, on the other hand, it results in a profile with smooth outside contour 30 (FIG. 4), as well as a profile with box-shaped sidewalls 18 (FIG. 6) which are mounted centrally relative to the end regions 19, 20 with reinforced profile. The person skilled in the art will adapt the suitable contour to the respective application case. The lower flange 16 in all cases ends flush with the associated end region 20. The upper flange 17 is positioned between the respective end regions 19 and is welded thereto, in the same way as the lower flange.

Figure 7:
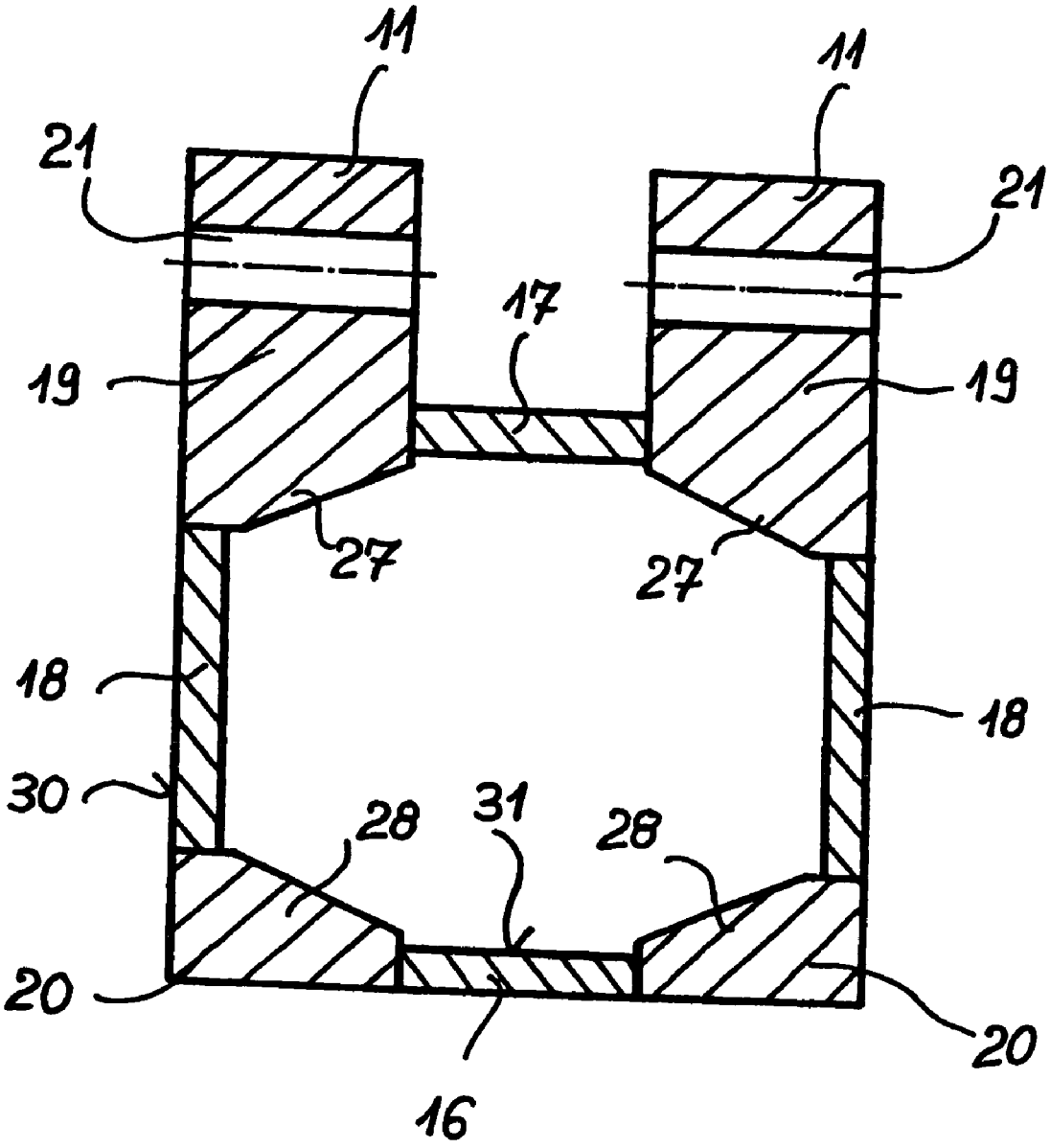

FIG. 7 shows alternatively embodied areas 27, 28 for reducing the cross section. The attachment points 21 for the cylinders 10 shown in FIG. 1 (not shown herein) are integrated into the profiles 11, but project over the outer contours in the other Figures. An essentially polygonal inside contour 31 is thus created, which has smooth outside contours 30.

Figure 4:
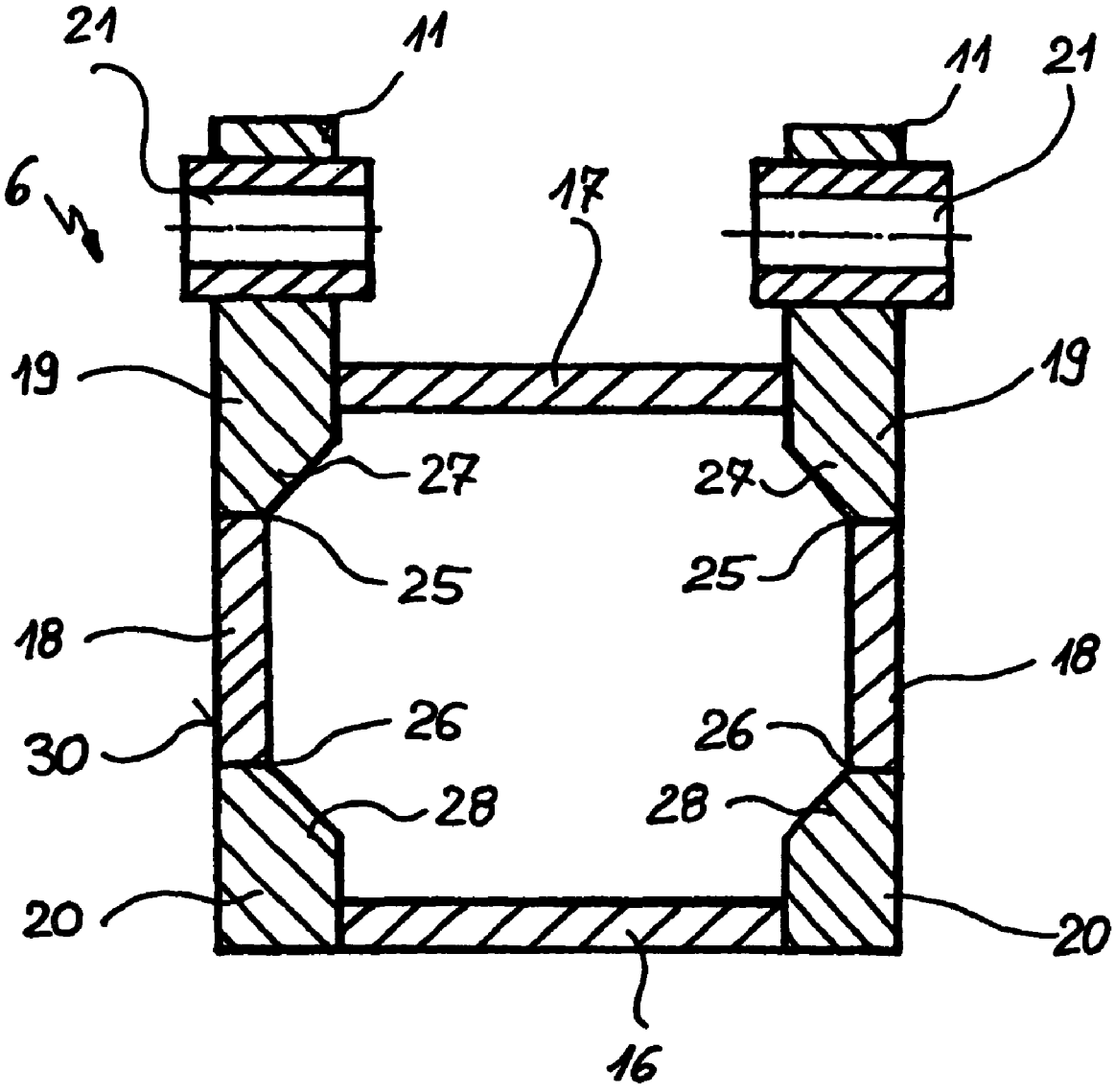
FIGS. 4 to 8 Show cross-sectional views through booms according to FIG. 3, provided with different reinforced profile end regions.
Figure 5:
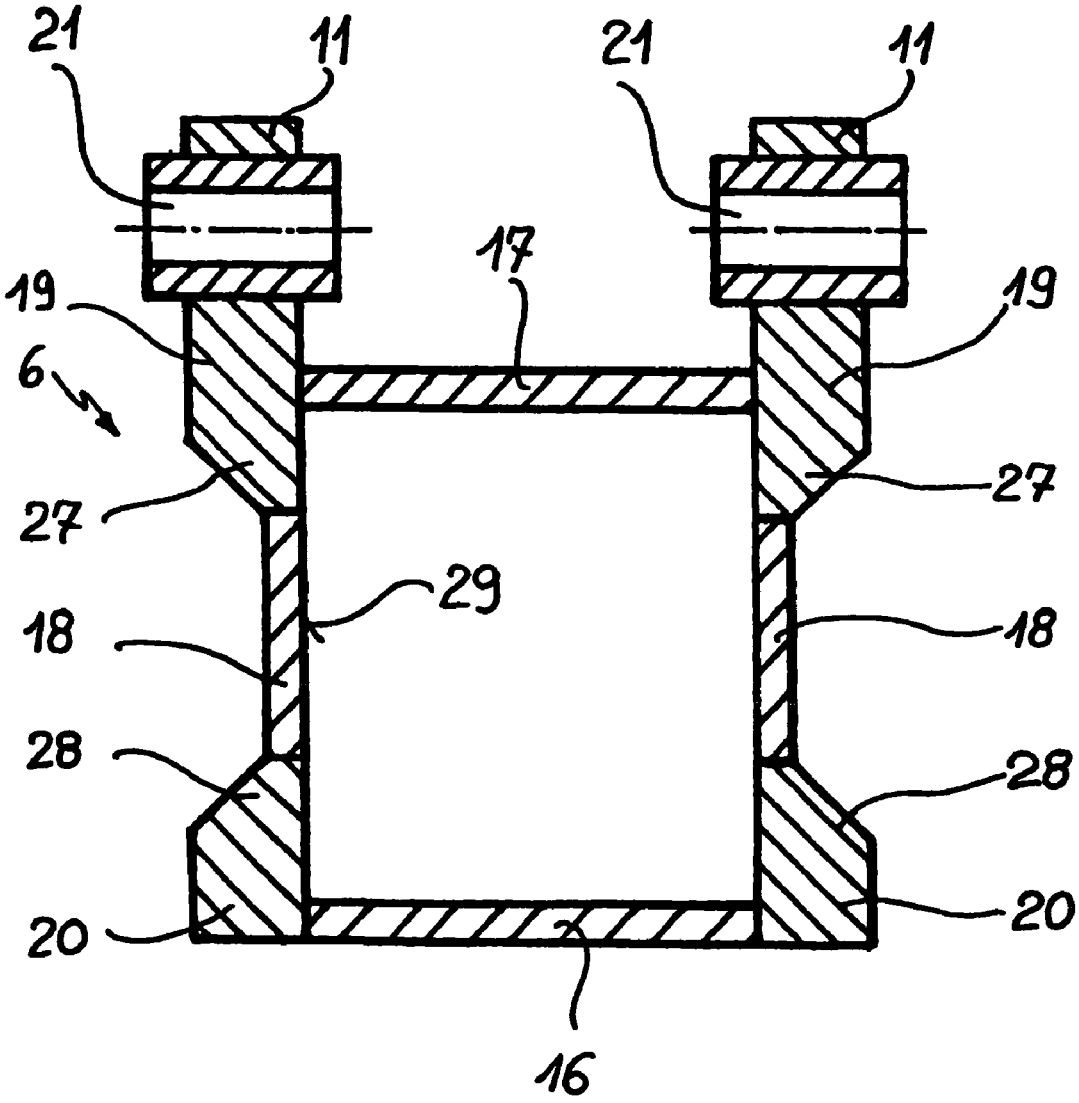
Figure 6:
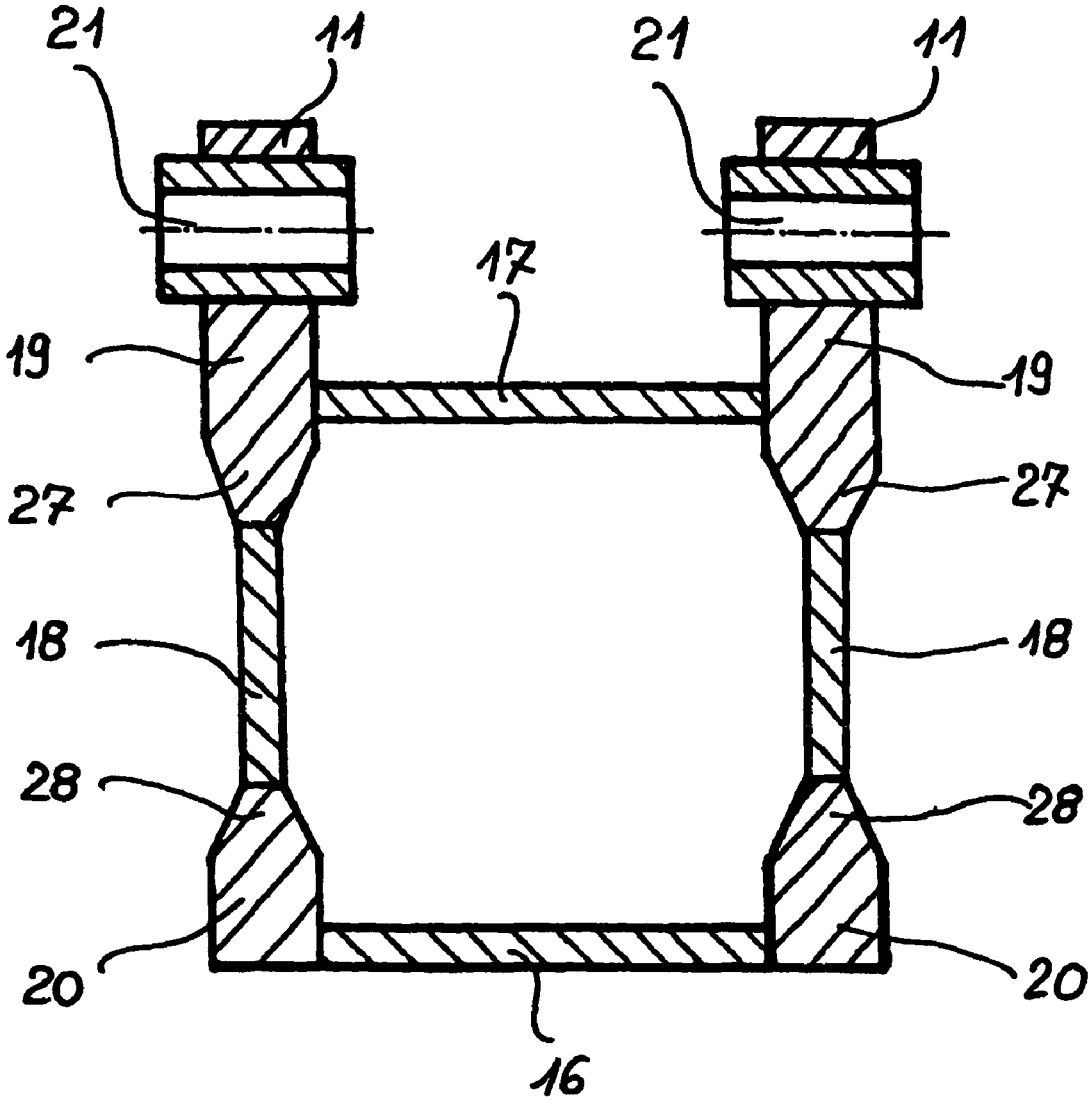
Figure 8:
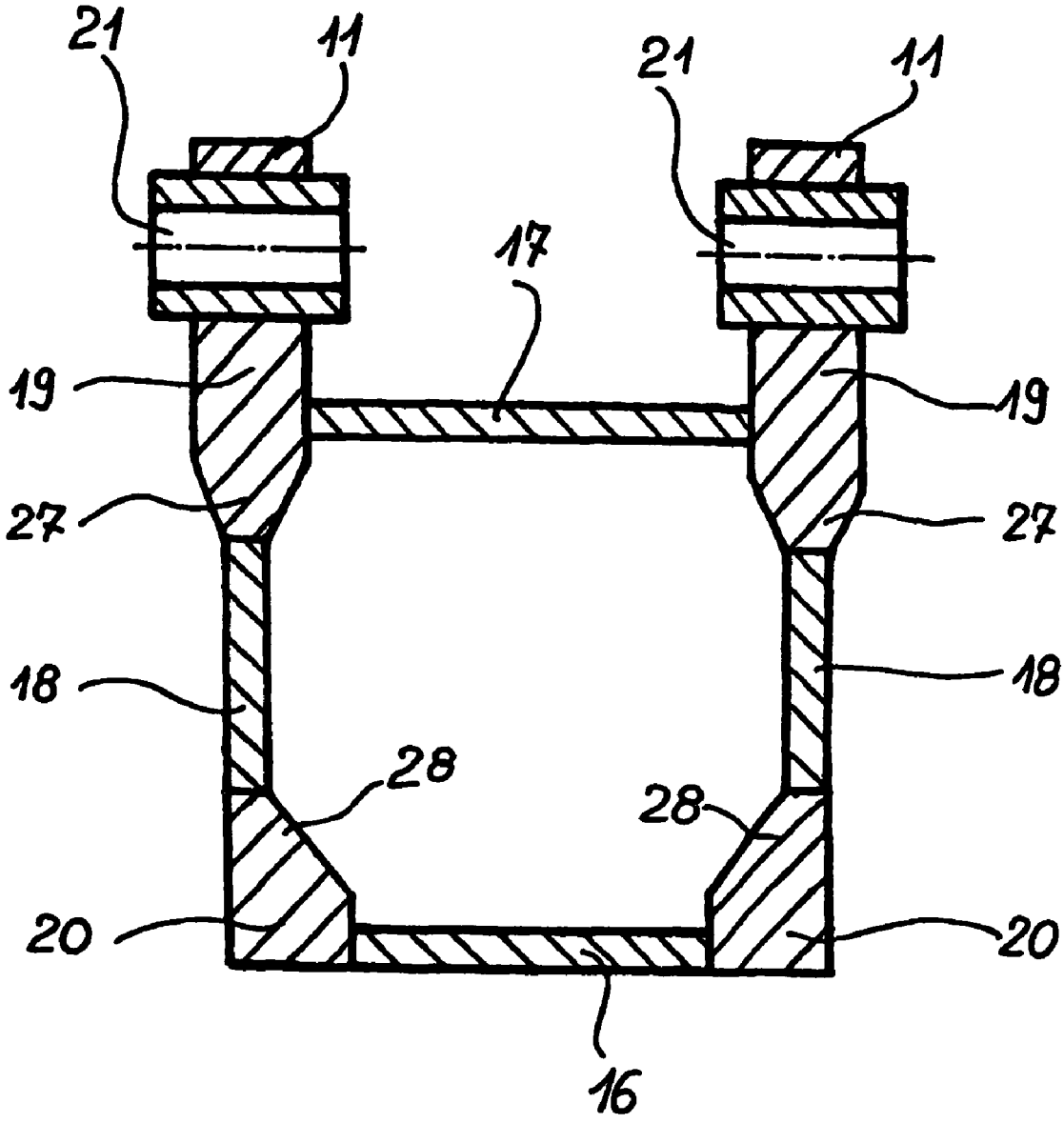

FIG. 8 demonstrates a combination of the cross-section reducing areas 27, 28 shown in FIGS. 4 and 6.

In all cases, the upper flange 17 and the lower flange 16 are connected in the end regions 19, 20, meaning the area with a reinforced profile cross section. As a result of the profile design, the welding seams are shifted to regions with lower stresses, wherein the stress concentration of the welding seams is reduced, thus leading to a not inconsiderable increase in the service life of the components.

Alternatively, it is possible to design the contour of the end regions 20 on the lower flange in such a way that they form integrated regions for the cylinder attachment points. This would be the version shown in FIGS. 4 to 8 which is turned by 180°. The person skilled in the art in that case would also adapt the correspondingly required structural design to the respective digger type.

The invention claimed is:

1. A welded profile for fitting a digger with a backhoe bucket or a loading shovel, said welded profile comprising:

an upper flange and a lower flange; and sidewalls operatively connected to the upper flange and lower flange, wherein the sidewalls comprise upper corner regions, lower corner regions and sidewall elements connecting the upper and lower corner regions, wherein each of the upper and lower corner regions comprise a reinforced profile, formed with a separate sheet-metal sheet, between the upper flange and the sidewall elements and between the lower flange and the sidewall elements, respectively, wherein the upper and lower corner regions are welded to the respective sidewall elements, wherein the sidewall elements have a thinner cross section than the upper and lower corner regions, and wherein at least one of the upper and lower corner regions include positioning locations for cylinder attachment points.

2. The profile as defined in claim 1, wherein at least the lower flange is positioned between the lower corner regions, so as to be essentially flush with the respective lower corner regions.

3. The profile as defined in claim 1, wherein the upper and lower corner regions include a reducing cross-sectional area.

4. The profile as defined in claim 3, wherein the reducing cross-sectional area faces the respective sidewall element.

5. The profile as defined in claim 3, wherein the reducing cross-sectional area ends flush with an inside contour of the respective sidewall element.

6. The profile as defined in claim 3, wherein the reducing cross-sectional area ends flush with an outside contour of the respective sidewall element.

7. The profile as defined in claim 3, wherein the reducing cross-sectional area converges towards an inside and outside contour of the respective sidewall element.

8. The profile as defined in claim 1, wherein the upper corner regions include a contour connected to the upper flange and which accommodates the cylinder attachment points.

9. The profile as defined in claim 1, further comprising a connection element welded on an exposed end region of the profile and comprising a hollow-box design, wherein a cross-section of the connection element is adapted to a cross-section of the exposed end region.

10. The profile as defined in claim 1, wherein the upper and lower corner regions are connected by welding to the respective upper flange and lower flange.

11. A method for producing a welded profile for fitting a digger with a backhoe bucket or loading shovel, comprising:

welding sidewall elements to upper and lower reinforced-profile corner regions to form sidewalls;

inserting and welding a lower flange between the lower reinforced-profile corner regions;

inserting and welding an upper flange between the upper reinforced-profile corner regions; and forming a contour of the welded profile so that the corner regions comprise integrated regions for the cylinder attachment points.

12. The method as defined in claim 11, wherein the sidewalls and the corner regions are shaped to match a contour of a connected boom or arm.

13. The method as defined in claim 11, wherein contours of the corner regions on the lower flange comprise integrated regions for the cylinder attachment points.

14. The method as defined in claim 11, including forming the corner regions with higher reinforcement than the sidewall elements and with reducing cross-sectional areas that are fixed to the respective sidewall element.

* * * * *